US011062556B2

(12) United States Patent
Froy

(10) Patent No.: US 11,062,556 B2
(45) Date of Patent: Jul. 13, 2021

(54) PRIVACY MODE AUGMENTED REALITY (AR) FOR ELECTRONIC GAMING MACHINE

(71) Applicant: IGT, Las Vegas, NV (US)

(72) Inventor: David Froy, Lakeville-Westmorland (CA)

(73) Assignee: IGT, Las Vegas, NV (US)

( * ) Notice: Subject to any disclaimer, the term of this patent is extended or adjusted under 35 U.S.C. 154(b) by 71 days.

(21) Appl. No.: 16/165,618

(22) Filed: Oct. 19, 2018

(65) Prior Publication Data

US 2020/0126354 A1 Apr. 23, 2020

(51) Int. Cl.

| | |
|---|---|
| ***G07F 17/00*** | (2006.01) |
| ***G07F 19/00*** | (2006.01) |
| ***G07F 17/32*** | (2006.01) |

(52) U.S. Cl.

CPC ..... *G07F 17/3241* (2013.01); *G07F 17/3211* (2013.01); *G07F 17/3223* (2013.01); *G07F 17/3227* (2013.01); *G07F 17/3239* (2013.01)

(58) Field of Classification Search

CPC ..... G07F 17/3211; G07F 17/3218; G07F 17/3223; G07F 17/3227; G07F 17/3237; G07F 17/3239; G07F 17/3241

See application file for complete search history.

(56) References Cited

U.S. PATENT DOCUMENTS

| | | | | |
|---|---|---|---|---|
| 6,445,364 | B2 * | 9/2002 | Zwern | G09B 9/00 345/156 |
| 2005/0164789 | A1 * | 7/2005 | Nakamura | A63F 13/843 463/36 |
| 2006/0073891 | A1 * | 4/2006 | Holt | A63F 13/213 463/30 |
| 2006/0287068 | A1 * | 12/2006 | Walker | G07F 17/3237 463/25 |
| 2007/0024002 | A1 * | 2/2007 | McMain | G07F 17/32 273/274 |
| 2009/0005163 | A1 * | 1/2009 | Quetglas Arino | G07F 17/3211 463/32 |
| 2009/0005165 | A1 * | 1/2009 | Arezina | G07F 17/32 463/37 |
| 2009/0176558 | A1 * | 7/2009 | Englman | G07F 17/3244 463/25 |

(Continued)

*Primary Examiner* — Milap Shah
(74) *Attorney, Agent, or Firm* — Sheridan Ross P.C.

(57) ABSTRACT

The present disclosure relates generally to a wearable device comprising a wireless communications interface, a display, a processor coupled with the wireless communications interface and display, and a memory coupled with and readable by the processor. The memory can store therein a set of instructions which, when executed by the processor, causes the processor to operate in a game play privacy mode in which the processor can pair with an EGM through the wireless communications interface and provide, to the EGM, information defining preferences for the privacy mode. The processor can receive, from the EGM through the wireless communications interface, a set of game play information related to the preferences for the privacy mode. The received set of game play information may not be presented on the EGM. The processor can present, through the display to a user of the wearable device, the game play information received from the EGM.

20 Claims, 7 Drawing Sheets

(56) References Cited

U.S. PATENT DOCUMENTS

| | | | | |
|---|---|---|---|---|
| 2010/0130280 | A1* | 5/2010 | Arezina | G07F 17/3206 463/20 |
| 2013/0210523 | A1* | 8/2013 | Arumugam | G07F 17/3218 463/31 |
| 2013/0281206 | A1* | 10/2013 | Lyons | G07F 17/3211 463/33 |
| 2013/0281207 | A1* | 10/2013 | Lyons | G07F 17/3206 463/33 |
| 2013/0281208 | A1* | 10/2013 | Lyons | G06K 9/00711 463/33 |
| 2013/0281209 | A1* | 10/2013 | Lyons | A63F 13/53 463/33 |
| 2014/0162762 | A1* | 6/2014 | Aoki | G07F 17/3223 463/25 |
| 2014/0235327 | A1* | 8/2014 | Aoki | G07F 17/323 463/25 |
| 2014/0302915 | A1* | 10/2014 | Lyons | G07F 17/3237 463/25 |
| 2015/0287265 | A1* | 10/2015 | Lyons | G07F 17/3206 463/25 |
| 2016/0093154 | A1* | 3/2016 | Bytnar | G07F 17/3286 463/25 |
| 2017/0165573 | A1* | 6/2017 | Froy | A63F 13/426 |
| 2017/0169664 | A1* | 6/2017 | Froy | G07F 17/3262 |
| 2018/0107835 | A1* | 4/2018 | Clement | A63F 13/211 |
| 2019/0099660 | A1* | 4/2019 | Nelson | G07F 17/3246 |
| 2020/0043279 | A1* | 2/2020 | Nelson | G07F 17/3211 |

* cited by examiner

PRIVACY MODE AUGMENTED REALITY (AR) FOR ELECTRONIC GAMING MACHINE

BACKGROUND

Embodiments of the present disclosure relate generally to augmented reality systems and more particularly to using augmented reality systems to provide privacy to players of Electronic Gaming Machines (EGMs).

Sometimes, users or players of EGMs want to have privacy when playing their games. For example, such users do not want other people watching over their shoulders while they are playing the game on the EGM. In some cases, they do not want these people to see how they are playing. If someone wins big, they don't want to worry about other people possibly trying to steal their money when they cash out. Other times, such as when playing for a progressive prize, the player may not want other people who see the large amount they are chasing and then try to pressure the player to get off the machine to try to take the pot themselves. Some EGMs perform responsible gaming functions to detect and help potential problem gamblers. In such cases, the player may want to use the responsible gaming features but would feel stigmatized by others nearby knowing they have a problem.

BRIEF SUMMARY

According to one embodiment, an Electronic Gaming Machine (EGM) can comprise a display, a wireless communications interface, a processor coupled with the display and wireless communications interface, and a memory coupled with and readable by the processor. The memory can store a set of instructions which, when executed by the processor, causes the processor to operate in a privacy mode. When operating in the privacy mode, the processor pairs with a wearable device of a player through the wireless communications interface and receives, from the wearable device, information defining preferences for the privacy mode. The processor can present, through the display, a user interface comprising a first set of game play information. The first set of game play information can be selected based on the information defining preferences for the privacy mode. The processor can also provide, to the wearable device through the wireless communications interface, a second set of game play information. The second set of game play information can be selected based on the information defining preferences for the privacy mode and may not be included in the user interface presented though the display of the EGM.

According to another embodiment, a wearable device can comprise a wireless communications interface, a display, a processor coupled with the wireless communications interface and display, and a memory coupled with and readable by the processor. The memory can store therein a set of instructions which, when executed by the processor, causes the processor to operate in a game play privacy mode. When operating in the privacy mode, the processor can pair with an EGM through the wireless communications interface and provide, to the EGM, information defining preferences for the privacy mode. The processor can receive, from the EGM through the wireless communications interface, a set of game play information related to the preferences for the privacy mode. The received set of game play information may not be presented on the EGM. The processor can present, through the display to a user of the wearable device, the set of game play information received from the EGM.

According to yet another embodiment, a method for managing electronic game play in a privacy mode can comprise pairing, by an EGM, with a wearable device of a player of a game executed by the EGM and receiving, by the EGM from the wearable device, information defining preferences for the privacy mode. The EGM can present a user interface of the game comprising a first set of game play information. The first set of game play information can be selected based on the information defining preferences for the privacy mode. The EGM can also provide, to the wearable device, a second set of game play information. The second set of game play information can be selected based on the information defining preferences for the privacy mode, and the first and second sets of game play information can be different. Input from a sensor of the wearable device can be received by the EGM which can monitor the player based on the received input.

Additional features and advantages are described herein and will be apparent from the following Description and the figures.

DETAILED DESCRIPTION

For various reasons, players of electronic games want to maintain at least some degree of privacy when playing such games in public venues like casinos. Generally speaking, embodiments of the present disclosure are directed to using an augmented reality device worn by the player. Through this device, private information can be presented to the player but hidden from observers nearby. The information presented in this way can be predefined by the player or selected by the player based on options available for the game being played.

Figure 1:
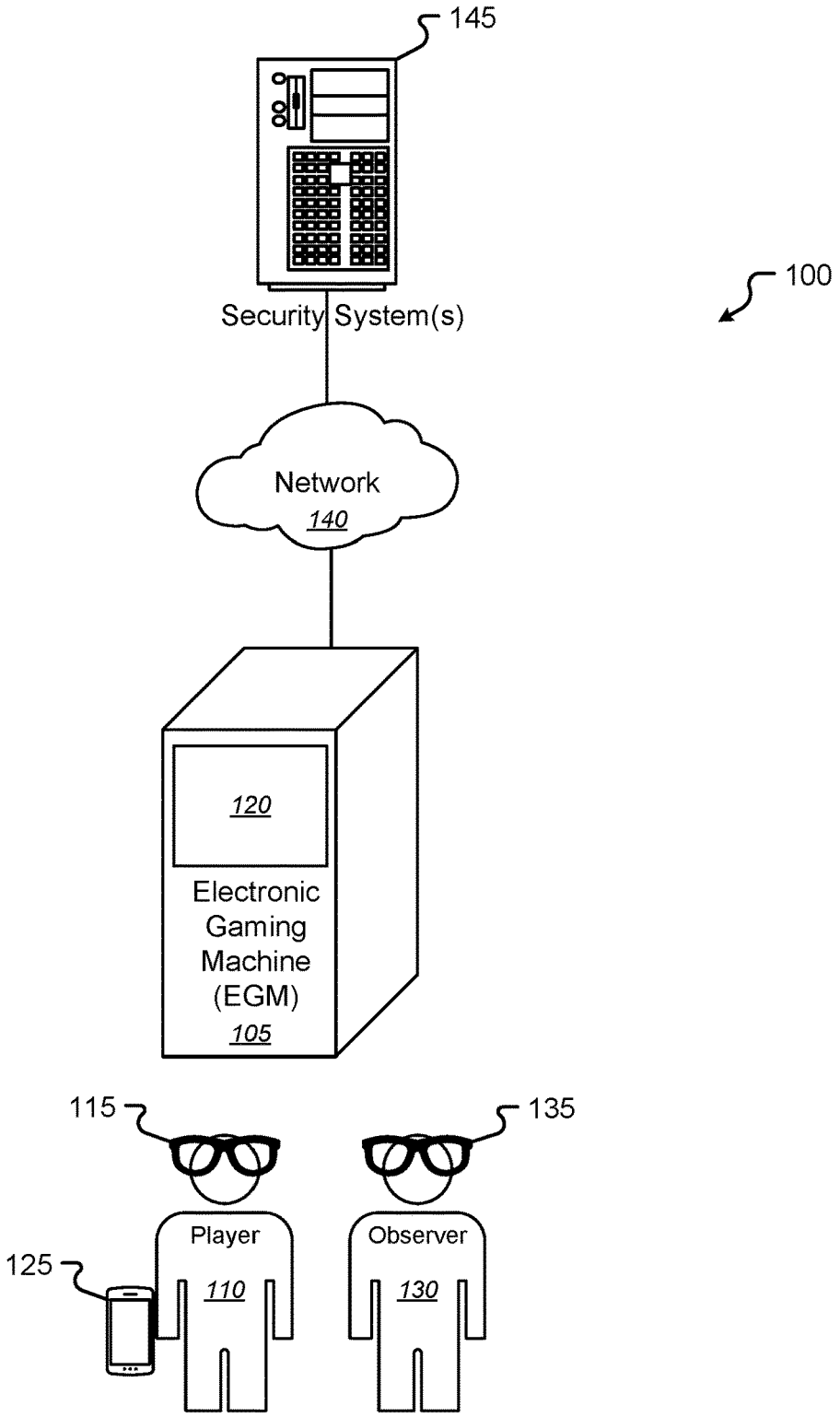
FIG. 1 is a block diagram illustrating an exemplary system for providing a privacy mode in electronic gaming according to one embodiment of the present disclosure.

FIG. 1 is a block diagram illustrating an exemplary system for providing a privacy mode in electronic gaming according to one embodiment of the present disclosure. As illustrated in this example, such a system 100 can comprise an Electronic Gaming Machine (EGM) 105 and a player 110. The EGM 105 can comprise, for example, any type of electronic device providing an electronic version of a game of chance including, but not limited to, video poker, video roulette, video black jack, video craps, video slots, video bingo, video pachinko, etc. It should be understood that, while one EGM 105 and one player 110 are illustrated here for the sake of simplicity and for illustrative purposes only, any number of EGMs 105 may be employed, for example in a casino, and these machines can be accessed and utilized by any number of players 110 at any given time.

The system 100 can also include a wearable device 115 such as a mixed reality headset worn by the player 110. The wearable device 115 can connect to the EGM 105 using a wireless connection, e.g., WIFI such as IEEE 802.11n, 802.11 ac, or similar, Bluetooth 4.0, 5.0 or similar, or other wireless communications. The wearable device 115 can include a microprocessor and screen, such as a transparent or semi-transparent lens onto which a holographic image can be projected, and which can cover one or both eyes of the player 110. In other implementations, the display can comprise a waveguide display using a mini-projector Digital Light Processing (DLP) or Light Emitting Diode (LED) display.

When the player 110 first sits down at the EGM 105 wearing the wearable device 115, the player 110 can be given the option to pair the device 115 with the EGM 105. For example, this option can comprise a prompt presented on a display 120 of the EGM 105 or the display of the wearable device 115. To pair with the wearable device 115, the EGM 105 can generate and provide a one-time code that represents the EGM 105. This code can be provided by the EGM 105 to the wearable device 115 over the wireless connection or can be presented on the display 120 of the EGM 105 to be entered into the wearable device. For example, the wearable device 115 can include a camera capturing a front-facing view of the player 110 when the device 115 is being worn by the player 110. This camera, when the wearable device 115 is pointed towards the display 120 of the EGM 105 can capture the code and the wearable device 115 can read and capture the code. In other cases, the player 110 may input the code into the device, e.g., by speaking the code in cases where the wearable device 115 is equipped with a microphone and speech recognition capabilities, by hand gestures, e.g., "pressing" keys of a virtual keypad projected onto the display of the wearable device 115, by entering or scanning the code with a mobile device 125 paired with the wearable device 115, etc. In yet other cases, the code can comprise a serial number or other unique identifier printed on the EGM 105 itself, such as in the form of a barcode or QR code, and the player 110 can input the code by scanning it with their mobile device 125, looking at it through the wearable device 115, etc. According to one embodiment, this code, once input into the wearable device 115, can then be used as a key to encrypt/decrypt communications between the EGM 105 and wearable device 115.

With the EGM 105 and wearable device 115 paired, the player 110 can be prompted with a question in the wearable device 115 asking whether they wish to enable privacy mode. Generally speaking, privacy mode provides the ability for the players to hide game play information such as the player's 110 current bet, credits, line wins, player points, comps from the venue, the current player bank balance, current features enabled, progressive pots, and reel elements which would typically be presented on the display 120 of the EGM 105. Instead, this information can be suppressed or hidden on the display 120 of the EGM 105 and presented through the wearable device 115 wherein it can be seen by the player 110 and not made viewable by an observer 130.

According to one embodiment, the player 110 can also be prompted with a list of options for privacy mode which they can toggle off/on. For example, options may be presented through the wearable device 115 to select which information or features from the display 120 of the EGM 105 will be presented instead through the wearable device 115 when operating in privacy mode. These selections can be made by the player 110, for example, by hand gestures "touching" the options at a location which they appear to be floating in front of the player 110, by selecting them through the display 120 of the EGM 105, e.g., by touching or tapping the displayed options if the display 120 is touch sensitive, by speaking the options if the wearable device 115 is equipped with a microphone and speech recognition abilities, etc.

Once a feature is selected, that feature can be displayed in the wearable device 115 and not on the display 120 of the EGM 105. If the wearable device 115 includes a camera, a video stream from that camera can be used to track the real-world objects within its field of view, including the display 120 of the EGM 105, and map the area within that field of view. The features selected for privacy mode can be presented in the wearable device 115 based on this mapping so that they appear to float over the display 120 of the EGM 105 at a location that the feature would be displayed if the EGM 105 were not operating in the privacy mode. If the player 110 turns away from the EGM 105, the virtual features can stay fixed on the EGM 105. If the wearable device 115 does not include a camera or does not support world object tracking, the features selected for privacy mode can be presented at a fixed location within the display of the wearable device 115, and this overlay can stay fixed no matter where the player 110 looks.

According to one embodiment, a mobile device 125 of the player 110 may be used in conjunction with the wearable device 115. For example, the mobile device 125, such as a smartphone, tablet, etc., may execute a mobile wallet or banking application. Such an application can be used to store an indication of credits available to the player 110. Since this application maintains information uniquely identifying the player 110, e.g., an account number etc., it can be used by the EGM 105 during the pairing process with the wearable device 110 to authenticate the player. Additionally, or alternatively, the application can also be used to transfer credits, i.e., money, to the EGM 105 for game play. When the player 110 inserts money into the bill acceptor or transfers money to the EGM from the mobile device 125, the amount can be displayed on which ever device, i.e., the display 120 of the EGM 105 or in the wearable device 115, the player 110 has chosen it to be displayed on. If the wearable device 115 is selected, a bank amount widget can appear through the wearable device 115 to be floating where it would normally be presented on the display 120 of the EGM 105 rather than actually being presented on the display 120 of the EGM 105. At any time, the user can choose to display or enable the widget by picking a configure privacy mode button either on the display 120 of the EGM 105 or on the wearable device 115.

As illustrated in this example, the system 100 can also include an observer 130 also with a wearable device 135. The wearable device 135 can be the same as or similar to the wearable device 115 of the player 110. According to one embodiment, the wearable device 115 of the player 110 can pair with the wearable device 135 of the observer 135, e.g., via Bluetooth, WiFi, or other wireless communication channel, in a manner similar to pairing with the EGM 105. For example, when the wearable device 135 of the observer is within a detectable range of the wearable device 115 of the player 110, the player 110 can be prompted through the wearable device 115 and asked if he would like to allow the observer 130 to paired. If the player 110 accepts and the wearable device 135 of the observer 130 is paired with the wearable device of the player 110, the observer 130 can join the privacy mode. While the EGM 105 is paired with wearable device 115 of the player 110 but not the wearable device of the observer 130, the wearable device 115 of the player 110 can relay the selected, private game play information from the EGM 105 to the wearable device 135 of the observer 130 once the two are paired. The wearable device 135 of the observer 130 can then present the game play information in a manner similar to the wearable device 115 of the player 110 as described above. In this way, a friend or family member, for example, can join the privacy mode and watch the game play of the player 110.

According to one embodiment, the EGM 105 can also provide responsible gaming features. When paired with the wearable device 115 of the player 110 and operating in privacy mode, the responsible gaming features of the EGM 105 can be hidden from those nearby. The player 110 can set up personal responsible gaming features such as time limits, spending limits, pause/rest reminders, game play speed settings, enable/disable anticipation features and game clock, which can be stored, for example, in a user profile of the wearable device 115 and transmitted to the EGM 105 during the pairing process. Such information and/or notices, alerts, warnings, etc., related to these settings can then be presented to the user through the wearable device 115 rather than the display 120 of the EGM 105.

According to one embodiment, various sensors can be built into the wearable device 115. For example, these sensors can include, but are not limited to, one or more user-facing cameras pointed towards one or both eyes of the player, a heart rate monitor, a blood pressure monitor, electroencephalogram (EEG) monitor, etc. Each such sensor can collect biometric data about the player 110 and send that data to the EGM 105 to be processed. The responsible gaming functions of the EGM 105 can monitor and analyze this data, perhaps in combination with game play behaviors of the player 110 detected by the EGM including, but not limited to, button press frequency, bet per line, number of lines covered, amount of money in/out of the terminal, etc., and compare such data to a model defining gambling behaviors of problem gamblers. The various factors compared can be weighted based on known habits of problem gamblers. Additionally, or alternatively, the model used for the comparison, the weights applied, etc., can be adapted over time based on various machine learning techniques. Based on this comparison, the EGM 105 can detect possible problem gambling and take some action. For example, the EGM 105 can give private alerts to the player 110 through the wearable device 115 warning of possible issues and perhaps provide suggestions for help, e.g., a website link or telephone number for an organization providing assistance to problem gamblers.

Similarly, input from such sensors can be used to detect a decline in the player's 110 cognitive abilities, for example, due to too much alcohol or drowsiness. For example, user facing cameras of the wearable device can provide a view of one or both eyes of the player 110 and eye or gaze tracking functions within the wearable device 115 and/or the EGM 105 can detect eye movement patterns indicative of intoxication. Similarly, wandering of the eyes or drooping of the eyelids as detected by the eye tracking functions can be used to determine that the player is drowsy or falling asleep. In such cases, the EGM 105 can provide warning to the player 110 though the wearable device 115. For example, if the wearable device 115 includes a speaker or headphone, the EGM 105 can cause the wearable device 115 to play a sound to alert the player 110 that they may want to take a break. Additionally, or alternatively, the EGM 105 can provide, through the wearable device 115, information on responsible gaming and problem gamblers, information on responsible alcohol consumption and/or alcoholism, contact information for help, etc.

According to one embodiment, the EGM 105 can be coupled with a communication network 140. For example, each EGM 105 in a casino or other venue may be coupled with a wired or wireless Local Area Network (LAN). Through this network, the EGM can communicate with various back office systems such as a banking system, for example. As illustrated in this example, a security system 145 can be coupled with the communication network 140. In some cases, the responsible gaming features of the EGM 105 may communicate information to the security system 145 via the communication network 140. For example, if a problem gambler is detected or if a player 110 is determined to be intoxicated, the EGM 105 may send an alert to the security system 145 which may then take further actions consistent with the alert. For example, the security system 145 may temporarily suspend the player's 110 banking account with the venue to prevent the player 110 from further gambling or drinking. In other cases, the security system 145 may simply monitor the player through video surveillance and/or other such systems of the casino or other venue.

Figure 2A:
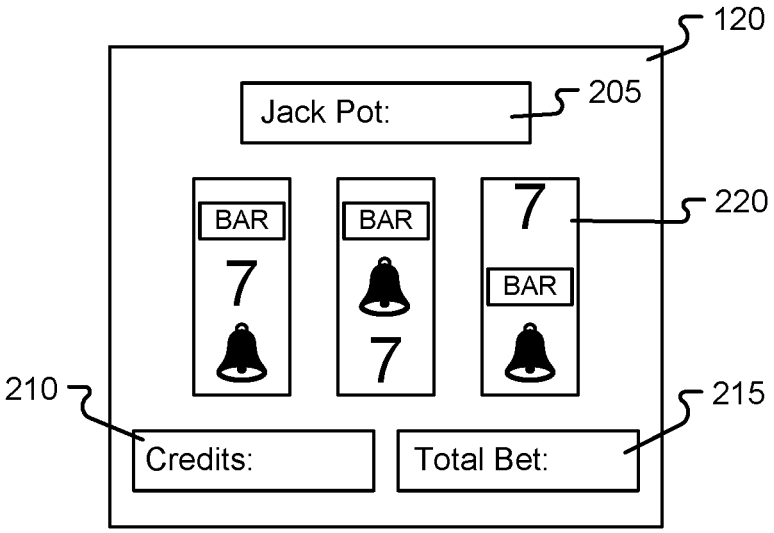
FIG. 2A illustrates an exemplary user interface display of an electronic gaming machine operating in a privacy mode according to one embodiment of the present disclosure.

FIG. 2A illustrates an exemplary user interface display of an electronic gaming machine operating in a privacy mode according to one embodiment of the present disclosure. As illustrated in this example, the display 120 of the EGM 105 can present a number of features 205, 210, 215, and 220. As described above, the player 110 can select which features will be presented in privacy mode. For example, and as illustrated here, the player 110 may select a feature 205 showing a value of a progressive prize to be shown in privacy mode. Accordingly, and as shown here, the value of this feature 205 is not presented on the display 120 of the EGM 105. Similarly, the player may select, for example, a feature 210 providing information on available credit and a feature 215 providing information on a current bet. Again, while the feature 210 and 215 may be represented on the display of the EGM, the value of the features 210 and 215 are not presented. In other implementations, the entire feature 210 and 215 may be suppressed or hidden on the display 120 of the EGM 105. Additional features, such as a feature 220 representing slot machine reels or other game play features, may not be selected for privacy made and therefore these features 220 are presented in the display 120 of the EGM 105.

Figure 2B:
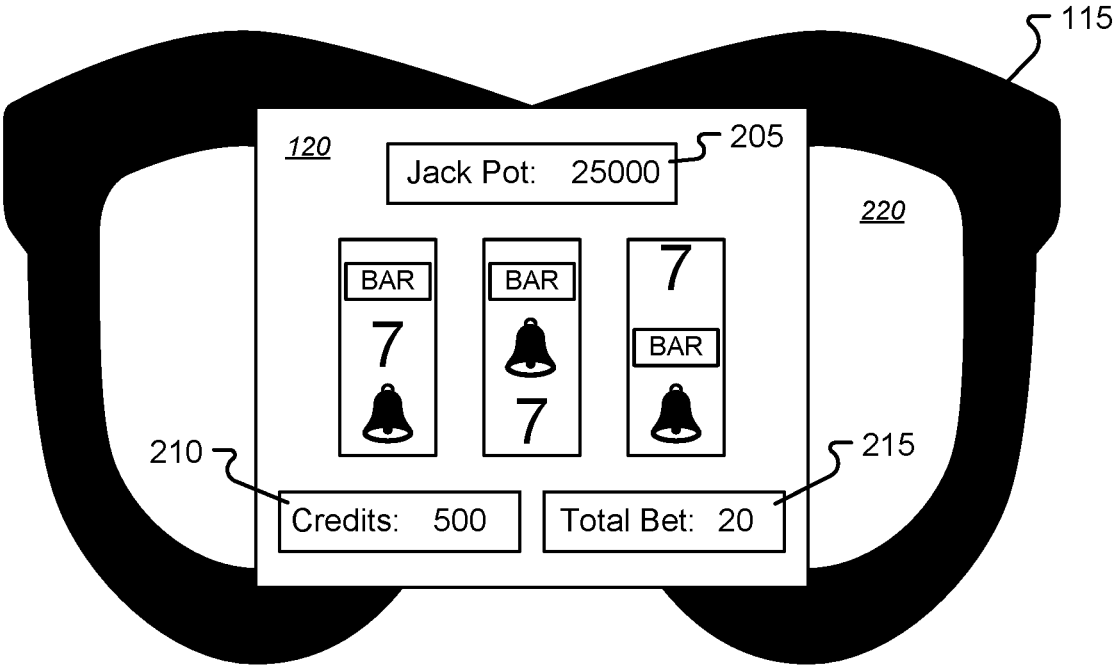
FIG. 2B illustrates an exemplary user interface display of a wearable device operating in a privacy mode and when viewing the electronic gaming machine of FIG. 2A.

FIG. 2B illustrates an exemplary user interface display of a wearable device operating in a privacy mode and when viewing the electronic gaming machine of FIG. 2A. This example represents a view of the display 120 of the EGM 105 as the player 110 is looking at it through the wearable device 115. As shown here, the player 110 can view the display 120 of the EGM 105 through the lens or display 220 of the wearable device 115. Additionally, the player 110 can see, projected on the display 220 of the wearable device, the features 205, 210, and 215 suppressed or hidden on the display 120 of the EGM 105. As noted above, these features 205, 210, and 215 can be presented on the display 220 of the wearable device 115 based on a mapping of the features 205, 210, and 215 to a video stream received from a camera (not shown here) of the wearable device 115 so that they appear to float over the display 120 of the EGM 105 at a location that the feature 205, 210, and 215 would be displayed if the EGM 105 were not operating in privacy mode and the features 205, 210, and 215 were not suppressed. In other cases, such as if the wearable device 115 is not equipped with a front facing camera, the selected information represented by the features could be displayed in a fixed location on the display 220 of the wearable device 115.

Figure 3:
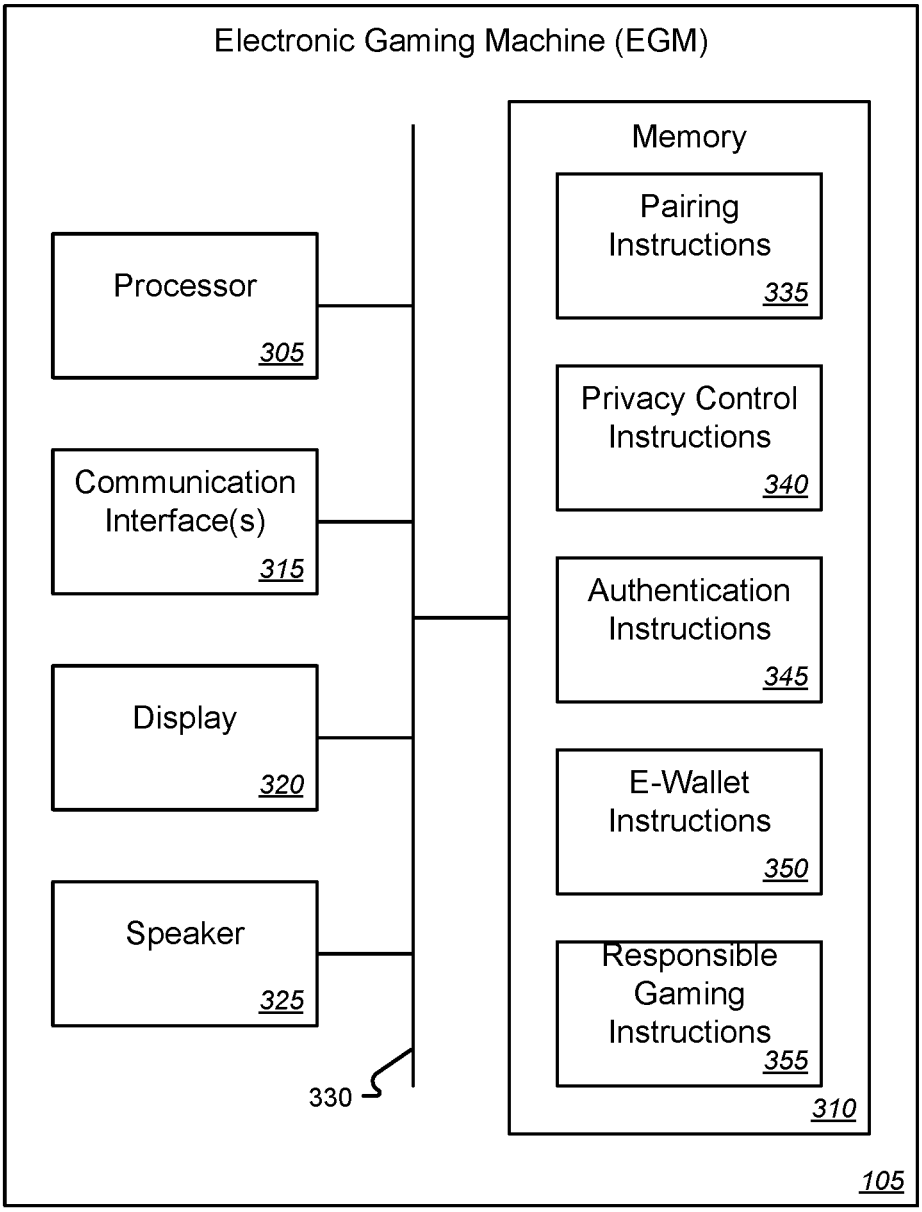
FIG. 3 is a block diagram illustrating additional details of an exemplary electronic gaming machine according to one embodiment of the present disclosure.

FIG. 3 is a block diagram illustrating additional details of an exemplary electronic gaming machine according to one embodiment of the present disclosure. As illustrated in this example, an EGM 105 can comprise a processor 305. The processor 305 may correspond to one or many computer processing devices. For instance, the processor 305 may be provided as silicon, as a Field Programmable Gate Array (FPGA), an Application-Specific Integrated Circuit (ASIC), any other type of Integrated Circuit (IC) chip, a collection of IC chips, or the like. As a more specific example, the processor 305 may be provided as a microprocessor, Central Processing Unit (CPU), or plurality of microprocessors that are configured to execute the instructions sets stored in a memory 310. Upon executing the instruction sets stored in memory 310, the processor 305 enables various functions of the EGM 105 as described herein.

A memory 310 can be coupled with and readable by the processor 305 via a communications bus 330. The memory 310 may include any type of computer memory device or collection of computer memory devices. Non-limiting examples of memory 310 include Random Access Memory (RAM), Read Only Memory (ROM), flash memory, Electronically-Erasable Programmable ROM (EEPROM), Dynamic RAM (DRAM), etc. The memory 310 may be configured to store the instruction sets depicted in addition to temporarily storing data for the processor 305 to execute various types of routines or functions.

The processor 305 can also be coupled with one or more communication interfaces 315 and a display 320 via the communications bus 330. The communication interfaces 315 can comprise, for example, a Bluetooth, WiFi, or other type of wireless communications interface. In some cases, the communication interfaces can also include an interface for communicating via a wired or wireless LAN. The display 320 can comprise, for example, a Liquid Crystal Display (LCD), Light Emitting Diode (LED), Organic Light Emitting Diode (OLED), Plasma Display Panel (PDP), Cathode Ray Tube (CRT) display or other type of display for presenting video images. In some cases, the EGM 105 may also comprise a speaker 325 also coupled with the communications bus 330 and producing audio output based on based on signals from the processor 305.

The memory 310 can store therein sets of instructions which, when executed by the processor 305, cause the processor 305 to operate in a privacy mode as described herein. More specifically, the memory 310 can store a set of pairing instructions 335 which cause the processor 305 to pair with a wearable device 115 of a player 110 through the communication interfaces 315. When pairing with the wearable device 115, these instructions can cause the processor 305 to receive from a mobile device 125 of the player 110 through the communications interfaces 315, information identifying the player. For example, the mobile device 125 of the player 110 may execute a gaming access application which uses a player identifier and/or other information to uniquely identify the player. Such information can be received by the EGM 105 through he communication interfaces 315 as part of the pairing process performed by the processor 305 when executing the pairing instructions 335 Authentication instructions 345 stored in the memory 310 and executed by the processor 305 can then cause the processor 305 to authenticate 515 the player 110 based on this information. The pairing instructions 335 can further cause the processor 305 of the EGM 105 to provide to the wearable device 115 through the communication interfaces 315 a one-time code identifying the EGM 105 to the wearable device 115. This code can be used, for example, to encrypt the game play information provided to the wearable device 115 by the EGM 105.

The memory can also store a set of privacy control instructions 340 which, when executed by the processor 305, cause the processor to set up and operate the privacy mode based on a set of preferences for the player 110. For example, during pairing, the EGM 105 can receive through the communication interfaces 315 information defining a default or initial set of preferences for the privacy mode from the wearable device 115. As described herein, these preferences can define which game features are displayed through the EGM 105 and which will be displayed through the wearable device 115 during game play. In some cases, the privacy control instructions 340 can additionally, or alternatively, cause the processor 305 to provide, through the communication interfaces 315 to the wearable device 115, a prompt identifying a plurality of options for an aspect of the privacy mode. For example, the prompt can identify a plurality of options for an aspect of the privacy mode available through the EGM but not indicated in the information defining the in initial or default preferences for the privacy mode received from the wearable device. The privacy control instructions 340 can cause the processor 305 to receive, through the communication interfaces 315, information from the wearable device 115 indicating a selection of an option from the plurality of options, i.e., additional preferences for operating in the privacy mode.

A set of e-wallet instructions 350 can also be stored in the memory 310 and executed by the processor 305. These instructions 350, when executed by the processor 305 can cause the processor to communication with an e-wallet or banking application executed on the mobile device 125 of the player 110. For example, these e-wallet instructions 350 can cause the processor 305 of the EGM 105 to receive, from the mobile device 125, information indicating an available game play credit for the player 110. The player can then use this credit to place wagers and the e-wallet instructions 350 can cause the processor 305 of the EGM 105 to update the e-wallet application on the mobile device 125 of the player 110 accordingly. Similarly, if the player 110 wins during game play causing the credit available to increase, the e-wallet instructions 350 can cause the processor 305 of the EGM 105 to update the e-wallet application on the mobile device 125 of the player 110 to reflect this increase.

During game play, the privacy control instructions 340 can cause the processor 305 to present, through the display 320 of the EGM 105, a user interface comprising a first set of game play information. As described above, this first set of game play information can be selected based on the information defining preferences for the privacy mode and can be suppressed or hidden in the user interface presented though the display 320 of the EGM 105. The privacy control instructions 340 can also cause the processor 305 to provide to the wearable device 115, through the communication interfaces 315, a second set of game play information. The second set of game play information can be selected based on the information defining preferences for the privacy mode. As described, this set of information is not presented on the display 320 of the EGM 105 but instead, will be presented to the player 110 through the wearable device 115. For example, based on the information defining preferences for the privacy mode, this second set of information may include the information indicating the available game play credit. In another example, this second set of information may include sounds associated with the game. In such cases, the privacy control instructions 340 can further cause the processor 305 of the EGM 105 to mute sounds related to game play through the speaker 325 and provide data representing the sounds related to game play to the wearable device 115 through the communication interfaces 315. The muted sounds that are no longer played on the EGM can be played instead through the wearable device 115.

In some cases, the memory 310 can also store a set of responsible gaming instructions 355. According to one embodiment, these instructions, when executed by the processor 305 of the EGM 105, can cause the processor 305 to receive input from a sensor of the wearable device and monitor the player 110 based on the received input. For example, these sensors can include, but are not limited to, one or more user-facing cameras pointed towards one or both eyes of the player, a heart rate monitor, a blood pressure monitor, EEG monitor, etc. In addition to monitoring input from these sensors, the responsible gaming instructions 355 can also cause the processor 305 to monitor actions taken by the player during game play, e.g., button press frequency, bet per line, number of lines covered, amount of money in/out of the terminal, etc. The responsible gaming instructions 355 can then cause the processor 305 of the EGM 105 to determine, based on the monitoring of the player 110, whether the player 110 has a gambling problem. As noted, this determination can be made by comparing the monitored activities and biometrics of the player 110 to a model maintained by the responsible gaming instructions that defines such characteristics for those known to be problem gamblers.

Similarly, the responsible gaming instructions 355 can cause the processor 305 of the EGM 105 to determine whether a cognitive ability of the player has declined over time as game play progresses. For example, the sensor input from the wearable device 115 can comprise video from a user facing cameras of the wearable device 115 providing a view of one or both eyes of the player 110. Eye tracking functions within the wearable device 115 and/or the responsible gaming instructions of the EGM 105 can detect eye movement patterns indicative of intoxication, wondering of the eyes or drooping of the eyelids indicative of the player 110 being drowsy or falling asleep, etc.

Based on this monitoring, the responsible gaming instructions 355 can then cause the processor 305 of the EGM 105 to take some action as described above. For example, in response to determining the player may have a gambling problem, the responsible gaming instructions 355 can cause the processor 305 of the EGM 105 to provide a private message to wearable device 115 through the communication interfaces 315. In another example, in response to determining the cognitive ability of the player has declined, the responsible gaming instructions 355 can cause the processor 305 of the EGM 105 to provide a private alert to wearable device 115 through the communication interfaces 315. In yet another example, the responsible gaming instructions 355 can cause the processor 305 of the EGM 105 to provide, through the communication interfaces 315 information to a security system of a casino or other venue in which the EGM 105 is installed.

As game play progresses, the privacy control instructions 340 can cause the processor 305 to suppress or hide some game play information through the display 320 and instead provide that information through the communication interfaces 315 to the wearable device 115 for presentation to the player 110 as described herein. According to one embodiment, one of the sensors of the wearable device 115 can comprise a camera. The input from the camera received by the EGM 105 can comprise a video stream. In such cases, the privacy control instructions 340 can cause the processor 305 to determine, based on the video stream, whether the player 110 is looking at the EGM 105. In response to determining the player is not looking at the EGM 105, the privacy control instructions 340 can pause the providing of the game play information to the wearable device 115. If or when it is determined that the player is again looking at the EGM 105, the privacy control instructions 340 can cause the processor 305 to resume providing the game play information to the wearable device 115.

Figure 4:
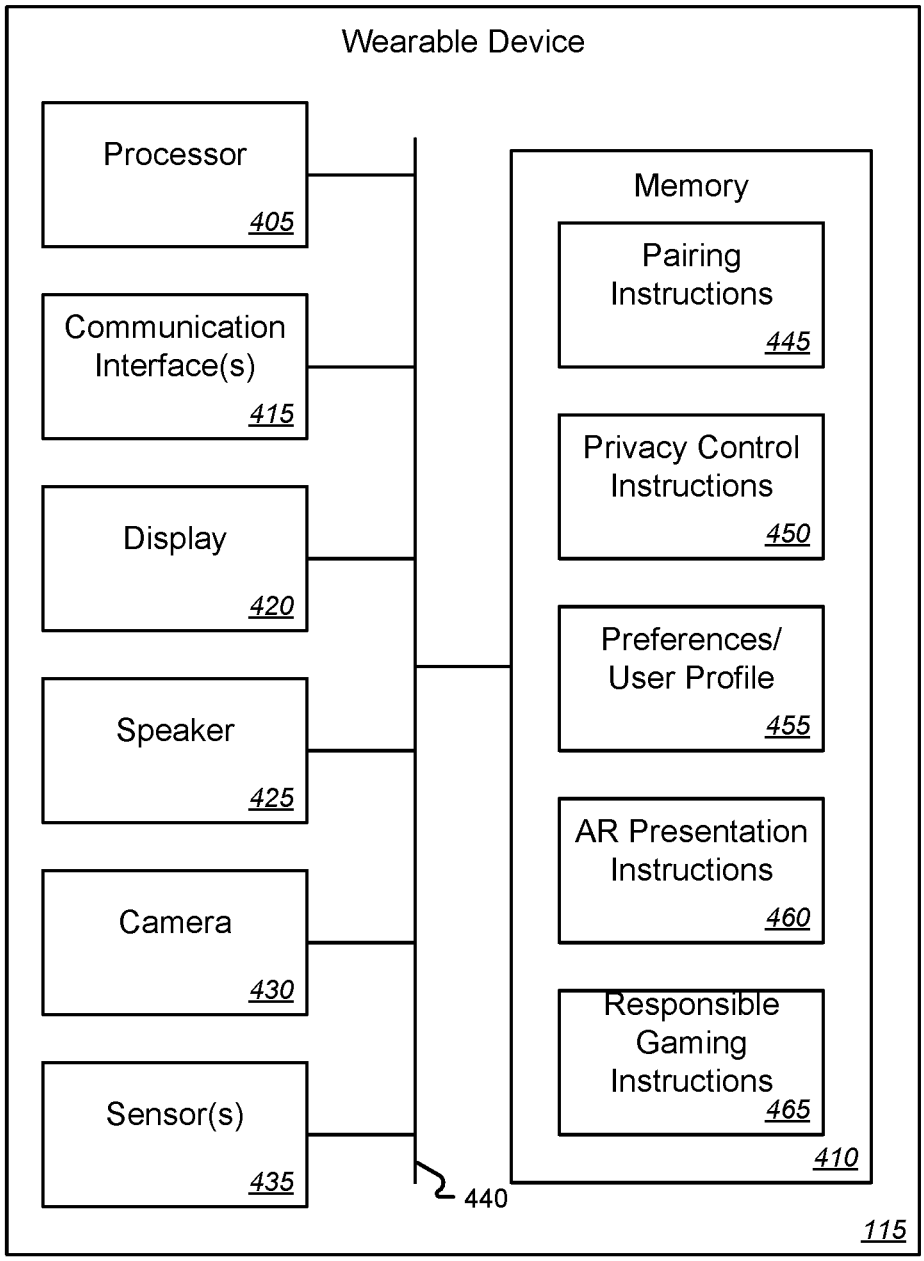
FIG. 4 is a block diagram illustrating additional details of an exemplary wearable device according to one embodiment of the present disclosure.

FIG. 4 is a block diagram illustrating additional details of an exemplary wearable device according to one embodiment of the present disclosure. As illustrated in this example, a wearable device 115 can comprise a processor 405 such as any of the various types of processors described above. A memory 410 can be coupled with and readable by the processor 405 via a communications bus 440. The memory 410 can comprises any one or more of the different types of volatile and/or non-volatile memories described above. The processor 405 can also be coupled with one or more communication interfaces 415 and a display 420 via the communications bus 440. The communication interfaces 415 can comprise, for example, a Bluetooth, WiFi, or other type of wireless communications interface. The display 420 can comprise, for example, a transparent or semi-transparent lens onto which a holographic image can be projected, and which can cover one or both eyes of the player 110. In some implementations, the display can comprise a waveguide display using a mini-projector Digital Light Processing (DLP) or Light Emitting Diode (LED) display.

The memory 410 can store therein sets of instructions which, when executed by the processor 405, cause the processor 405 to operate in a privacy mode as described herein. More specifically, the memory 410 can store a set of pairing instructions 445 which cause the processor 405 to pair with an EGM 105 through the communication interfaces 415. When pairing with the EGM 105, the pairing instructions 445 can cause the processor 405 of the wearable device 115 to receive, from the EGM 105 through the communications interface 415, a prompt indicating an availability of the privacy mode, receive an input indicating a selection to turn on the privacy mode and send, to the EGM 105 through the communications interface 415, a request to turn on the privacy mode.

According to one embodiment, privacy control instructions 450 may cause the processor 405 to read one or more privacy mode settings from a set of preferences or a user profile 450 maintained in the memory 410 of the wearable device 115 and provide those settings to the EGM 105 as a default or initial setup for the privacy mode. In some cases, the privacy control instructions 450 can further cause the processor 405 to receive, from the EGM 105 through the communication interfaces 415, a prompt identifying a plurality of options for an aspect of the privacy mode available through the EGM 105, which may not be defined in the initial setup, if any, present on the display 420 of the wearable device 115, a representation of the prompt received from the EGM 105, receive an input indicating a selection of one of the plurality of options, and send, to the EGM 105 though the communication interfaces 415, information indicating the selection. The privacy control instructions 450 can then save these selections in the set of preferences or user profile 450 for later use when pairing with the same or a different EGM 105.

During game play, the privacy control instructions 450 can cause the processor 405 of the wearable device 115 to receive, from the EGM 105 through the communication interfaces, a set of game play information related to the preferences for the privacy mode and present the received set of game play information to the player 110 through the display 420. In some cases, the wearable device 115 can further comprise a speaker 425 coupled with the processor through the communications bus 440 and some of the received game play information can represent audio related to the game play. In such cases, the privacy control instructions 450 can further cause the processor 405 to play the audio through the speaker 425 of the wearable device 115

According to one embodiment, the wearable device 115 can further comprise a camera 430 coupled with the communication bus 440 and a set of AR presentation instructions 460 stored in the memory 410 of the wearable device 115. The camera 430 can capture video or images of a front-facing view, from the perspective of the player 110 wearing the wearable device. The AR presentation instructions 460 can cause the processor 405 to align the presented game play information with the display of the EGM 105 based on the received video or images. Aligning the presented game play information with the EGM 115 can comprise aligning the presented game play information with a position on the EGM 115 where the presented game play information is presented by the EGM 115 when not in the privacy mode.

The wearable device 115 can further comprise, according to one embodiment, a sensor measuring a biometric parameter of the player 110 and the memory 410 can have stored therein a set of responsible gaming instructions 465. The responsible gaming instructions 465, when executed by the processor 405 of the wearable device 115, can cause the processor to receive an input from the sensor and perform a gaming control function based on the input. For example, the sensor can comprise a user-facing camera pointed towards one or both eyes of the player, a heart rate monitor, a blood pressure monitor, electroencephalogram (EEG) monitor, etc. In such cases, performing a game control function can comprise determining, based on the monitoring of the player 110, whether the player 110 has a gambling problem. Similarly, the responsible gaming instructions 465 can cause the processor 405 to determine whether a cognitive ability of the player has declined over time as game play progresses. In either case, performing a game control function can comprise displaying a message to the player 110 through the display 420 of the wearable device 115, playing an announcement or sounding an alert through the speaker 425 of the wearable device, etc.

According to one embodiment, the privacy control instructions 450 can further cause the processor 405 to detect and pair with another wearable device 135 through the communication interfaces 415. For example, the processor 405 can detect a wearable device of an observer nearby. In such cases, the privacy control instructions 450 can cause the processor 405 to prompt the player, through the display 420 and/or speaker 425 of the wearable device 115 to inform the player 110 of the presence of the observer 130 and ask for permission to pair with the wearable device 135 of the observer 130. In response to the player 110 agreeing or granting permission, the privacy control instructions 450 can cause the processor 405 to provide to the other wearable device 135, through the communication interfaces 415, the set of gaming information received from the EGM 105.

Figure 5:
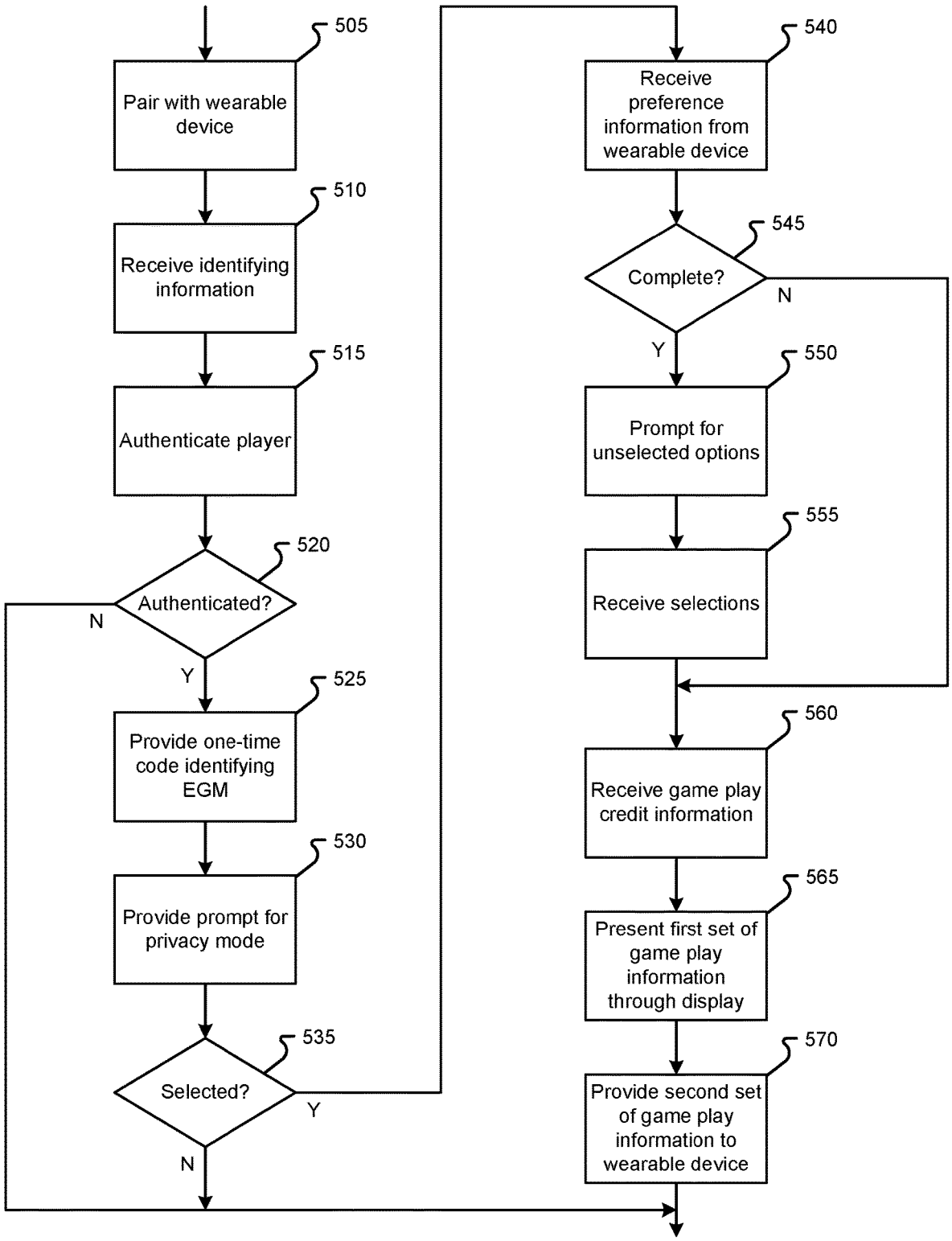
FIG. 5 is a flowchart illustrating an exemplary process for providing a privacy mode in electronic gaming according to one embodiment of the present disclosure.

FIG. 5 is a flowchart illustrating an exemplary process for providing a privacy mode in electronic gaming according to one embodiment of the present disclosure. More specifically, this example illustrates a process for operating in a privacy mode by an EGM 105 as described herein. As illustrated here, operating in a privacy mode can comprise pairing 505 with a wearable device 115 of a player 110 through a wireless communications interface. When pairing 505 with the wearable device 115, the EGM 105 can receive 510, from a mobile device 125 of the player 110, information identifying the player 110 and can authenticate 515 the player 110 based on the information received from the mobile device 125. In response to determining 520 that the player is authenticated, a one-time code identifying the EGM 105 can be provided 525 to the wearable device 115. The one-time code can be used to encrypt and decrypt game play information provided to the wearable device 115.

A prompt can be provided 530 to the wearable device 115 indicating that privacy mode is available. A determination 535 can be made as to whether privacy mode is selected by the player 110. In response to determining 535 privacy mode is selected, preferences can be established for conducting privacy mode between the EGM 105 and wearable device 105. For example, the EGM 105 can receive 540 a set of initial preference information from the wearable device 115 if preferences have previously been set by the wearable device 115. A determination 545 can be made as to whether set up is complete. In response to determining 545 that no preferences have been set or that preferences available through the EGM 105 have not yet been selected for the wearable device, the wearable device 115 can be provided 550 with one or more prompts identifying a plurality of options for the aspect of the privacy mode available through the EGM but not indicated in the information defining preferences for the privacy mode received from the wearable device 115. Information indicating selection of an option from the plurality of options can be received 555 from the wearable device 115. In some cases, the EGM 105 may also receive 560, from the mobile device 125 of the player 110, information indicating an available game play credit for the player 110.

A user interface can be presented 565 through the display 120 of the EGM 105. The user interface can comprise a first set of game play information. The first set of game play information can be selected based on the information defining preferences for the privacy mode. A second set of game play information can be provided 570 to the wearable device 115. The second set of game play information can be selected based on the information defining preferences for the privacy mode and/or the information indicating the selection of the option from the plurality of options and is not included in the user interface presented though the display of the EGM. For example, the second set of game play information can comprise the information indicating the available game play credit or other information identified by the preferences and/or selected options and which is suppressed or hidden in the display of the EGM 105.

Figure 6:
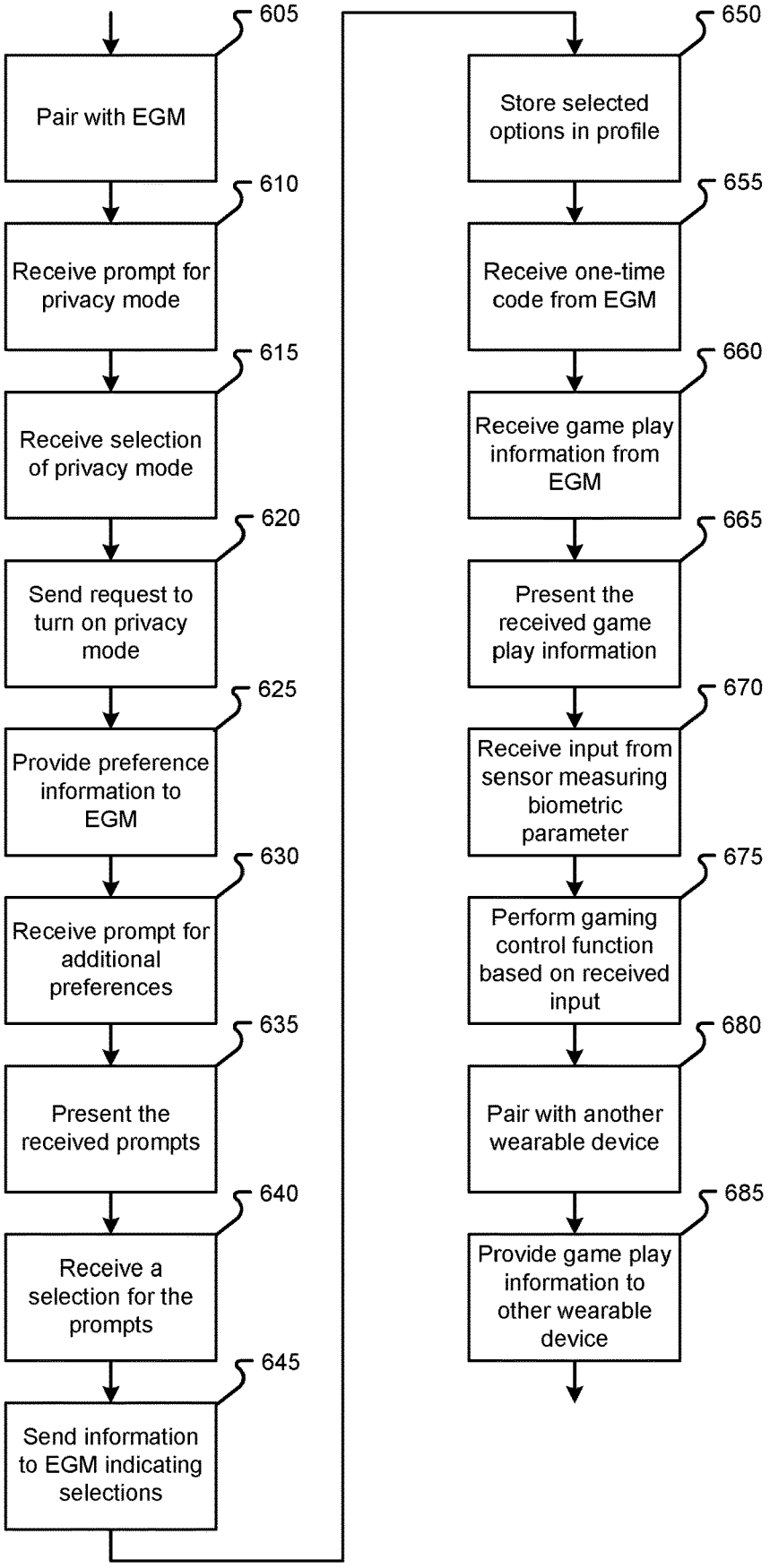
FIG. 6 is a flowchart illustrating an exemplary process for providing a privacy mode in electronic gaming according to another embodiment of the present disclosure.

FIG. 6 is a flowchart illustrating an exemplary process for providing a privacy mode in electronic gaming according to another embodiment of the present disclosure. More specifically, this example illustrates a process for operating in a privacy mode by a wearable device 115 as described herein. As illustrated here, operating in a privacy mode can comprise pairing 605 with an EGM 105 through the wireless communications interface. When pairing with the EGM 105, the wearable device 115 can receive a prompt indicating an availability of the privacy mode, receive 615 an input indicating a selection to turn on the privacy mode, and send 625 to the EGM 105 a request to turn on the privacy mode.

Preference information can be provided 625 to the EGM 105. The preference information can define settings for aspects of the privacy mode. A prompt identifying a plurality of options for another aspect of the privacy mode available through the EGM, but not indicated in the preference information, can be received 630 from the EGM 105. A representation of the prompt received from the EGM 105 can be presented 635 on the display of the wearable device 115, an input indicating a selection of one of the plurality of options can be received 640, and information indicating the selection can be sent 645 to the EGM 115. The selected one of the plurality of options can be stored 650 in a preference profile maintained in the memory of the wearable device.

A one-time code can be received 655 from the EGM 105. The one-time code can uniquely identify the EGM to the wearable device. A set of game play information related to the preferences for the privacy mode can be received 660 from the EGM 105 through the wireless communications interface and presented 665 through the display to a user of the wearable device. In some cases, the received game play information may be encrypted and can be decrypted using the received one-time code. The received set of game play information is not presented on the EGM. The presented 665 game play information can be aligned with the EGM on the display of the wearable device based on images from a camera of the wearable device. Aligning the presented game play information with a position on the EGM where the presented game play information is presented by the EGM when not in the privacy mode.

An input can be received 670 from a sensor measuring a biometric parameter of a user of the wearable device and a gaming control function can be performed 675 based on the input. For example, the sensor can comprise a user-facing camera pointed towards one or both eyes of the player, a heart rate monitor, a blood pressure monitor, electroencephalogram (EEG) monitor, etc. In such cases, performing 675 a game control function can comprise determining, based on the monitoring of the player 110, whether the player 110 has a gambling problem or the cognitive ability of the player has declined. In either case, performing 675 a game control function can further comprise displaying a message to the player 110 through the display 420 of the wearable device 115, playing an announcement or sounding an alert through the speaker 425 of the wearable device, etc.

In some cases, the wearable device can pair 680 with another wearable device through the wireless communications interface and provide 685, to the other wearable device through the wireless communications interface, the set of gaming information received from the EGM. For example, the player can be prompted through the display and/or speaker of the wearable device 115 to inform the player 110 of the presence of the observer 130 and ask for permission to pair with the wearable device 135 of the observer 130. In response to the player 110 agreeing or granting permission, the wearable device 115 of the player 110 can be paired 680 with the other wearable device 135 and the set of gaming information received from the EGM 105 can be provided 685 from the wearable device 115 of the player 110 to the wearable device 135 of the observer 130.

Figure 7:
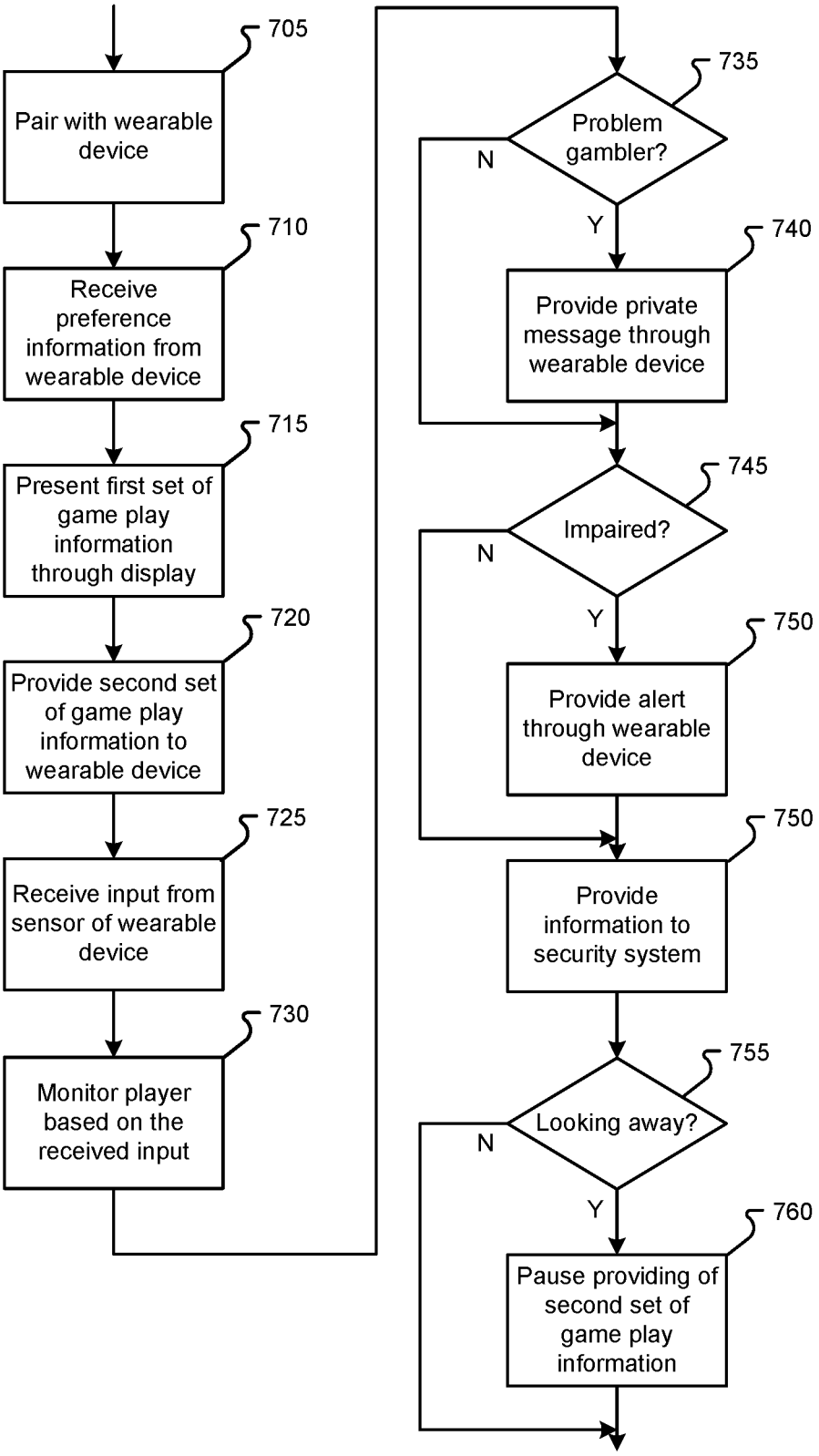
FIG. 7 is a flowchart illustrating an exemplary process for managing game play in a privacy mode according to one embodiment of the present disclosure.

FIG. 7 is a flowchart illustrating an exemplary process for managing game play in a privacy mode according to one embodiment of the present disclosure. More specifically, this example illustrates a process for managing electronic game play in a privacy mode by an EGM 105 as described herein. As illustrated here, managing electronic game play in a privacy mode can comprise pairing 705 with a wearable device 115 of a player 110 of a game executed by the EGM 105, receiving 710, from the wearable device 115, information defining preferences for the privacy mode, and presenting 715 a user interface of the game comprising a first set of game play information. The first set of game play information can be selected based on the information defining preferences for the privacy mode. A second set of game play information can be provided 720 to the wearable device. The second set of game play information can be selected based on the information defining preferences for the privacy mode and the first and second sets of game play information can be different.

Input from a sensor of the wearable device 115 can be received 725 by the EGM 105 and the player can be monitored 730 based on the received input. For example, these sensors can include, but are not limited to, one or more user-facing cameras pointed towards one or both eyes of the player, a heart rate monitor, a blood pressure monitor, electroencephalogram (EEG) monitor, etc. Monitoring 730 the player can further comprise monitoring, by the EGM, actions taken by the player during game play. These actions can include, but are not limited to, button press frequency, bet per line, number of lines covered, amount of money in/out of the terminal, etc.

Based on the monitoring of the player a determination 735 can be made as to whether the player has a gambling problem. This determination can be made by comparing the monitored activities and biometrics of the player 110 to a model maintained by the responsible gaming instructions that defines such characteristics for those known to be problem gamblers. In response to determining 735 the player has a gambling problem, a private message can be provided 740 to the player, by the EGM, through the wearable device.

Similarly, based on the monitoring of the player, a determination 745 as to whether a cognitive ability of the player has declined. For example, the sensor input from the wearable device 115 can comprise video from a user facing cameras of the wearable device 115 providing a view of one or both eyes of the player 110. Eye or gaze tracking functions can detect eye movement patterns indicative of intoxication, wondering of the eyes or drooping of the eyelids indicative of the player 110 being drowsy or falling asleep, etc. In response to determining 745 the cognitive ability of the player has declined, a private alert can be provided 750 to the player through the wearable device 115. In some cases, information can also be provided 755 to a security system of a casino or other venue in which the EGM is installed based on monitoring the player.

In some cases, the sensor of the wearable device 115 from which input is received 725 can comprise a camera and the input from the camera can comprise a video stream. In such cases, monitoring 730 the player can further comprise determining 760, based on the video stream, the player is not looking at the EGM 105. In response to determining 760 the player is not looking at the EGM, providing of the second set of game play information to the wearable device can be paused 765 by the EGM 105. Similarly, in response to determining the player is again looking at the EGM 105, providing of the second set of game play information to the wearable device can be resumed by the EGM 105.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C #, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

As used herein, the phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The invention is claimed as follows:

1. An Electronic Gaming Machine (EGM) comprising:
- a display;
- a wireless communications interface;
- a processor coupled with the display and wireless communications interface; and
- a memory coupled with and readable by the processor and storing therein a set of instructions which, when executed by the processor causes the processor to operate in a privacy mode and, when operating in the privacy mode, the processor:
  - pairs with a wearable device of a player through the wireless communications interface;
  - receives, from the wearable device, information defining preferences for the privacy mode;
  - presents, through the display, a user interface comprising a first set of game play information, wherein the first set of game play information is selected based on the information defining preferences for the privacy mode;
  - provides, to the wearable device through the wireless communications interface, a second set of game play information, wherein the second set of game play information is selected based on the information defining preferences for the privacy mode and is not included in the user interface presented through the display of the EGM, wherein the second set of game play information comprises a responsible gaming feature;
  - receives input from a sensor of the wearable device, wherein the sensor of the wearable device comprises a camera, wherein the input from the camera comprises a video stream;
  - monitors the player based on the received input, wherein monitoring the player comprises determining, based on the video stream, the player's gaze is not directed at the EGM; and
  - in response to determining the player's gaze is not directed at the EGM, pause the providing of the second set of game play information to the wearable device.

2. The EGM of claim 1, wherein, when the EGM pairs with the wearable device, the set of instructions further cause the processor of the EGM to:
- provide to the wearable device, a one-time code identifying the EGM to the wearable device; and
- encrypt the second set of game play information provided to the wearable device using the one-time code.

3. The EGM of claim 1, wherein, when the EGM receives the information defining preferences for the privacy mode from the wearable device, the set of instructions further cause the processor of the EGM to provide, through the wireless communications interface to the wearable device, a prompt identifying a plurality of options for an aspect of the privacy mode and wherein the information defining preferences for the privacy mode received from the wearable device comprises information indicating a selection of an option from the plurality of options.

4. The EGM of claim 1, wherein the set of instructions further cause the processor of the EGM to:
- provide, through the wireless communications interface to the wearable device, a prompt identifying a plurality of options for an aspect of the privacy mode available through the EGM but not indicated in the information defining preferences for the privacy mode received from the wearable device; and
- receive, through the wireless communications interface from the wearable device, information indicating a selection of an option from the plurality of options, wherein the second set of game play information is further based on the information indicating the selection of the option from the plurality of options.

5. The EGM of claim 1, further comprising a speaker, wherein the set of instructions further cause the processor of the EGM to mute sounds related to game play through the speaker and provide data representing the sounds related to game play to the wearable device based on the information defining preferences for the privacy mode.

6. The EGM of claim 1, wherein, when pairing with the wearable device, the set of instructions further cause the processor of the EGM to:
- receive, from a mobile device of the player through the wireless communications interface, information identifying the player; and
- authenticate the player based on information received from the mobile device.

7. The EGM of claim 6, wherein the set of instructions further cause the processor of the EGM to receive, from the mobile device, information indicating an available game play credit for the player and wherein the second set of game play information comprises the information indicating the available game play credit based on the information defining preferences for the privacy mode.

8. A wearable device comprising:
- a wireless communications interface;
- a display;
- a camera;
- a processor coupled with the wireless communications interface, camera, and display; and
- a memory coupled with and readable by the processor and storing therein a set of instructions which, when executed by the processor, causes the processor to operate in a game play privacy mode and, when operating in the game play privacy mode, the processor:
  - pairs with an Electronic Gaming Machine (EGM) through the wireless communications interface;
  - provides, to the EGM, information defining preferences for the privacy mode;
  - receives, from the EGM through the wireless communications interface, a set of game play information related to the preferences for the privacy mode, wherein the received set of game play information is not presented on the EGM;

presents, through the display to a user of the wearable device, the set of game play information received from the EGM, wherein the second set of game play information comprises a responsible gaming feature;

provides a video stream from the camera to the EGM, wherein the EGM monitors a player wearing the wearable device, determines whether the player's gaze is directed at the EGM, and in response to determining the player's gaze is not directed at the EGM, pauses set of game play information.

9. The wearable device of claim 8, wherein, when pairing with the EGM, the set of instructions further cause the processor of the wearable device to:

receive, from the EGM through the wireless communications interface, a prompt indicating an availability of the game play privacy mode;

receive an input indicating a selection to turn on the game play privacy mode; and send, to the EGM through the wireless communications interface, a request to turn on the game play privacy mode.

10. The wearable device of claim 8, wherein the set of instructions executed by the processor of the wearable device causes the wearable device to align the presented set of game play information with the EGM on the display based on images from the camera.

11. The wearable device of claim 10, wherein aligning the presented set of game play information with the EGM on the display comprises aligning the presented set of game play information with a position on the EGM where the presented set of game play information is presented by the EGM when not in the game play privacy mode.

12. The wearable device of claim 8, wherein, when pairing with the EGM, the set of instructions further cause the processor of the wearable device to:

receive, from the EGM through the wireless communications interface, a prompt identifying a plurality of options for an aspect of the game play privacy mode available through the EGM;

present on the display of the wearable device, a representation of the prompt received from the EGM;

receive an input indicating a selection of one of the plurality of options; and send, to the EGM though the wireless communications interface, information indicating the selection.

13. The wearable device of claim 11, wherein the set of instructions further cause the processor of the wearable device to store in a preference profile maintained in the memory of the wearable device a selected one of a plurality of options.

14. The wearable device of claim 8, further comprising a sensor measuring a biometric parameter of a user of the wearable device and wherein the set of instructions further cause the processor of the wearable device to receive an input from the sensor and perform a gaming control function based on the input.

15. A method for managing electronic game play in a privacy mode, the method comprising:

pairing, by an Electronic Gaming Machine (EGM), with a wearable device of a player of a game executed by the EGM;

receiving, by the EGM from the wearable device, information defining preferences for the privacy mode;

presenting, by the EGM, a user interface of the game comprising a first set of game play information, wherein the first set of game play information is selected based on the information defining preferences for the privacy mode;

providing, by the EGM to the wearable device, a second set of game play information, wherein the second set of game play information is selected based on the information defining preferences for the privacy mode and wherein the first and second sets of game play information are different, wherein the second set of game play information comprises a responsible gaming feature;

receiving, by the EGM, input from a sensor of the wearable device, wherein the sensor of the wearable device comprises a camera, wherein the input from the camera comprises a video stream;

monitoring, by the EGM, the player based on the received input, wherein monitoring the player comprises determining, based on the video stream, the player's gaze is not directed at the EGM; and in response to determining the player's gaze is not directed at the EGM, pausing, by the EGM, the providing of the second set of game play information to the wearable device.

16. The method of claim 15, wherein monitoring the player further comprises monitoring, by the EGM, actions taken by the player during game play.

17. The method of claim 16, further comprising:

determining, by the EGM, based on the monitoring of the player, whether the player has a gambling problem; and in response to determining the player has the gambling problem, providing, by the EGM, a private message to the player through the wearable device.

18. The method of claim 16, further comprising:

determining, by the EGM, based on the monitoring of the player, whether a cognitive ability of the player has declined; and in response to determining the cognitive ability of the player has declined, providing, by the EGM, a private alert to the player through the wearable device.

19. The method of claim 16, further comprising providing, by the EGM, information to a security system of a casino in which the EGM is installed, based on the monitoring of the player.

20. The method of claim 15, further comprising receiving, by the EGM, from the mobile device, information indicating an available game play credit for the player and wherein the second set of game play information comprises the information indicating the available game play credit based on the information defining preferences for the privacy mode.

* * * * *